US012331609B1

(12) United States Patent
Ellis et al.

(10) Patent No.: US 12,331,609 B1
(45) Date of Patent: Jun. 17, 2025

(54) LATCHING OF A SUBSEA COMPONENT TO A SUBSEA RECEPTACLE, ASSOCIATED SUBSEA SYSTEM AND METHOD

(71) Applicant: FMC Technologies, Inc., Houston, TX (US)

(72) Inventors: Kyle Ellis, Houston, TX (US); Christopher Kennedy, Spring, TX (US)

( * ) Notice: Subject to any disclaimer, the term of this patent is extended or adjusted under 35 U.S.C. 154(b) by 0 days.

(21) Appl. No.: 18/680,556

(22) Filed: May 31, 2024

(51) Int. Cl.
*E21B 33/038* (2006.01)
*E21B 41/04* (2006.01)
*E21B 43/00* (2006.01)

(52) U.S. Cl.
CPC ..... *E21B 33/038* (2013.01)

(58) Field of Classification Search
USPC ..... 166/360
See application file for complete search history.

(56) References Cited

U.S. PATENT DOCUMENTS 5,013,178 A * 5/1991 Baker ..... H01R 13/20 403/322.3
5,067,909 A * 11/1991 Behning ..... H01R 13/64 439/315
5,265,980 A * 11/1993 Lugo ..... E21B 33/0355 166/347
6,226,068 B1 * 5/2001 Arcykiewicz ..... H01R 13/625 439/314
8,011,434 B2 * 9/2011 Cosgrove ..... E21B 33/038 166/344
8,991,501 B2 * 3/2015 Roberts ..... E21B 33/038 166/344

(Continued)

*Primary Examiner* — Matthew R Buck
*Assistant Examiner* — Douglas S Wood

(57) ABSTRACT

The invention relates to a subsea equipment (100) and a subsea receptacle (200), a subsea system (1) comprising the subsea equipment (100) and the subsea receptacle (200) as well as a method of mounting the subsea equipment (100) to the subsea receptacle (200).

The subsea equipment (100) comprising:

a component body (101) configured to be received inside the subsea receptacle (200), the component body (101) extending, along a component axis (CA), in an axial direction (AD), between a connecting end (CCE) and a locking end (CLE), and a circumferential direction (CDC) about the component axis (CA);

a latching arrangement (150) connected to the locking end (CLE) of the component body (101) and being configured to rotate in the circumferential direction (CDC) being orthogonal to the axial direction (AD), the latching arrangement (150) comprising:

a rotatable portion (151) rotatably connected to the component body (101);

a component latching portion (160) extending from the rotatable portion (151), in the axial direction (AD), towards the connecting end (CCE) and comprising a component latching surface (161) extending in the circumferential direction (CDC) and facing towards said locking end (CLE);

a component locking portion (170) configured to interact with a detent (220) of the subsea receptacle (200) to counteract relative rotation between the latching arrangement (150) and the subsea receptacle (200) in the circumferential direction (CDC); and a spring (180) biasing the component locking portion (170) in a radial direction being orthogonal to the circumferential direction (CDC).

32 Claims, 8 Drawing Sheets

(56) References Cited

U.S. PATENT DOCUMENTS

| | | | | |
|---|---|---|---|---|
| 9,033,050 | B2 * | 5/2015 | Long | E21B 41/04 166/341 |
| 11,686,181 | B2 * | 6/2023 | Rosvold | H02G 1/10 166/338 |
| 2015/0204167 | A1 * | 7/2015 | Skeels | E21B 41/0007 166/344 |
| 2017/0328176 | A1 * | 11/2017 | Sales | E21B 41/0007 |
| 2019/0249508 | A1 * | 8/2019 | Holst | E21B 33/0387 |

* cited by examiner

LATCHING OF A SUBSEA COMPONENT TO A SUBSEA RECEPTACLE, ASSOCIATED SUBSEA SYSTEM AND METHOD

TECHNICAL FIELD

The present disclosure relates to latching of a subsea equipment to a subsea receptacle.

In particular, the invention relates to a subsea equipment configured to be mounted in a subsea receptacle, a subsea receptacle configured to receive a subsea equipment, a subsea system comprising the subsea equipment and the subsea receptacle, and a method of mounting the subsea equipment to the subsea receptacle.

BACKGROUND

When connecting a subsea equipment, e.g. an electric actuator to a subsea receptacle, e.g. an electric actuator receptacle, it is important to make sure that the equipment does not unintentionally unlatch itself from the subsea receptacle. Various solutions exist for latching and unlatching subsea electric actuators. These solutions include horizontal mounting of the actuator into a receptacle.

It is an objective of the invention to provide a subsea latching mechanism for easy latching and unlatching of a subsea equipment to a subsea receptacle.

The present invention is directed to a solution that may solve at least one of the aforementioned problems or challenges.

SUMMARY OF THE INVENTION

The invention is defined in the attached claims.

The present invention relates to a subsea equipment configured to be mounted in a subsea receptacle, the subsea equipment comprising:

- a component body configured to be received inside the subsea receptacle, the component body extending, along a component axis, in an axial direction, between a connecting end and a locking end, and a circumferential direction about the component axis;
- a latching arrangement connected to the locking end of the component body and being configured to rotate in the circumferential direction being orthogonal to the axial direction, the latching arrangement comprising:
  - a rotatable portion rotatably connected to the component body;
  - a component latching portion extending from the rotatable portion, in the axial direction, towards the connecting end and comprising a component latching surface extending in the circumferential direction and facing towards said locking end;
  - a component locking portion configured to interact with a detent of the subsea receptacle to counteract relative rotation between the latching arrangement and the subsea receptacle in the circumferential direction; and
  - a spring biasing the component locking portion in a radial direction being orthogonal to the circumferential direction.

The component latching portion is configured to be guided in an axial groove of the subsea receptacle.

The component body thus has a component axis along which it is extending, and the circumferential direction is about the component axis.

In other words, the circumferential direction may be seen to extend in a plane which is concentrically arranged about the component axis.

The component body may have a cylindrical shape such that the circumferential direction is along a circle.

The component latching portion provides axial retention or resistance, i.e. axial stop features, and rotational retention, i.e. rotational stop features, of the subsea equipment whereas the spring only provides rotational resistance of the subsea equipment. The properties of the component latching portion can be tuned to provide more or less axial resistance by tweaking the cross-sectional area or length.

The rotational retention of the component latching portion may ensure that the component locking portion is positioned in the detent, i.e. that the component locking portion is prevented from moving past the detent upon rotating the latching arrangement relative the subsea receptacle.

Additionally, the component latching portion may comprise chamfer features that will allow e.g. a Remotely Operated Vehicle (ROV) to overpull with an emergency load to unlatch a stuck subsea equipment from the subsea receptacle. The overpull load will open the component latching portion up and allow the equipment to be released. This load is also dictated by the cross-sectional area and length of the component latching portion.

The component latching surface of the component latching portion provides a positive stop feature in the axial direction. The component latching surface is configured to interact with an oppositely oriented receptacle latching surface on the subsea receptacle.

The force required to deflect the spring and the component locking portion over the detent provides the anti-rotation properties of the latching arrangement. The amount of anti-rotation can be tuned by changing either the deflection properties of the spring, such as cross-sectional area or length, or by changing the detent entry angle and height, such as features of a ramp as described below.

The properties of the spring and the component locking portion could be selected based on the demands for the specific project, such as:

- Materials could be selected for resistance corrosion mechanisms and to target elastic modulus to optimize spring rate,
- Spring geometry could be selected to optimize spring rate,
- Coatings, surface treatments, i.e. knurling, polishing, etc. could be included to optimize frictional component of retention force,
- Geometry of the component locking portion could be modified to optimize retention force, installation force, spring preload, etc.,
- Overall latching angle could be increased or decreased. Larger angles would improve observability of latch state by ROV or personnel.

The rotatable portion may circumferentially enclose at least a portion of the component body.

The spring may be arranged external relative to the detent such that it biases inwardly in the radial direction towards the detent.

An advantage of arranging the spring externally relative the detent is that it is visible from the outside and thus easier accessible. By using e.g a ROV, one may then visibly verify that the component locking portion is properly positioned in the detent.

Alternatively, the spring may be arranged internal relative to the detent, such that it biases outwardly towards the detent. Preferably the spring is arranged so that is does not protrude outside the other parts of the latching arrangements but at the same time is visible from the outside of the latching arrangement, hence thereby protected during operations.

The latching arrangement may comprise a handle.

The handle is preferably connected to the rotatable portion such that the rotatable portion rotates together with the handle.

The handle provides an interface for manipulation by e.g. ROV.

The handle may comprise visual marking to show angular position of the subsea equipment relative to the receptacle. The visual marking may be in the form of number of degrees rotated relative the subsea receptacle, or other types of visual marking.

The handle may comprise limit stops for crude orientation of the subsea equipment, facilitating installation into the receptacle.

The handle may serve as an attachment for the spring and the component locking portion.

When the handle contacts the subsea receptacle, it may provide a stop for movement of the subsea equipment relative the subsea receptacle in the axial direction.

Geometry of the handle could be modified to have other interfaces for direct handling by a ROV.

The handle could be formed of one part or it can be separated into multiple pieces. Said spring may bias the component locking portion towards the component body.

The component body may comprise an alignment pin configured to guide the component body into the subsea receptacle.

The alignment pin may angularly align the subsea equipment's radial features so it can be installed into the subsea receptacle.

Furthermore, the alignment pin, together with a pin guide of the subsea receptacle may lock the component body's rotational orientation to the subsea receptacle, which provides a torque path to allow e.g. a handle to rotate independently from the component body.

The alignment pin may form a leading feature to prevent the component latching portion from crashing into the receptacle if the subsea equipment is not correctly aligned.

Said component latching portion may comprise a groove inside which said spring is arranged.

The component latching portion may thus provide protection of the spring during assembly and installation as the spring could be easily damaged and result in loss of rotational resistance.

Said spring may be a blade spring. The spring may comprise a first end which is rigidly attached to the rotatable portion and a second end to which said locking portion is attached.

The subsea equipment may comprise a retention device connecting the latching arrangement to the component body, and the retention device may be configured to prevent axial movement of the latching arrangement relative to the component body, and to allow rotational movement of the latching arrangement relative to the component body.

The retention device may comprise visual marking to show angular position.

The retention device may comprise a first stop surface and a second stop surface, and the rotatable portion may comprise complementary first and second stop surfaces for interaction with the first stop surface and the second stop surface of the retention device.

The retention device can be securely connected to the component body using known means of fastening, such as e.g. screws, bolts, pins etc.

The retention device can be a retention plate. Alternatively, the retention device can be a retention ring. In yet a further alternative, the retention device may be formed by two pieces, where each piece is connected to the component body.

The distance between the first and second stop surfaces of the retention device defines the maximum allowable rotational movement of the rotatable portion, i.e. the first and second stop surfaces serve as angular limit stops for the rotatable portion and thus the handle. This is equal to a maximum number of degrees of rotation for the rotatable portion. Normally, the number of degrees of rotation for the rotatable portion is larger than the required number of degrees when moving between an unlatched position and a latched position, i.e. for the component latching portion of the latching arrangement to move from a position within the axial groove of the subsea receptacle to a position where the component locking portion interact with the detent.

The subsea equipment may be an electric actuator.

The subsea equipment and the subsea receptacle are preferably cylindrical. However, other complementary shapes could also be possible.

The present invention also relates to a subsea receptacle configured to receive a subsea equipment, where the subsea receptacle comprises:

- a receptacle body configured to receive the subsea equipment therein, the subsea receptacle body extending, along a receptacle axis, in an axial direction, between a receptacle connecting end and a receptacle locking end, and a circumferential direction about the subsea receptacle axis, the subsea receptacle body comprising;
  - an axial groove extending in the axial direction, from the subsea receptacle connecting end, and terminating in a stop end;
  - a receptacle latching portion, extending in the circumferential direction from the stop end, wherein the receptacle latching portion comprises:
    - a receptacle latching surface facing towards the subsea receptacle distal end;
    - a detent configured to interact with a component locking portion of a latching arrangement of the subsea equipment to counteract relative rotation between the latching arrangement and the subsea receptacle in the circumferential direction;
    - a ramp extending in the circumferential direction, between the stop end and the detent, to guide the component locking portion of the latching arrangement towards the detent.

The subsea receptacle body thus has a component axis along which it is extending, and the circumferential direction is about the subsea receptacle axis.

In other words, the circumferential direction may be seen to extend in a plane which is concentrically arranged about the subsea receptacle axis.

The subsea receptacle body may have a cylindrical shape such that the circumferential direction is along a circle.

The properties of the detent and the ramp could be selected based on the demands for the specific project, such as:

- Groove coating, surface treatments, i.e. knurling, polishing, etc., could be included to optimize frictional component of retention force,
- Geometry of detent and ramp angles could be modified to optimize retention force, installation force, spring preload, etc.,
- Entry chamfers could be increased in size to ease installation of the subsea equipment, The receptacle latching portion and the detent could be modified to lock upon installation. This could be combined with the overpull for destructive retrieval as the only option. The subsea equipment is then required to be replaced with a new unit with e.g. ROV.

The ramp may comprise a first ramp surface, a second ramp surface and a transition zone between the first ramp surface and the second ramp surface, where the first ramp surface may extend from the stop end to a transition zone, and the second ramp surface may extend from the transition zone to the detent.

A thickness of the first ramp surface may increase from the stop end towards the transition zone and a thickness of the second ramp surface may decrease from the transition zone towards the detent.

The second ramp surface may be steeper than the first ramp surface. This is advantageous in that a larger force is required to release the subsea equipment from the subsea receptacle than to latch the subsea equipment to the subsea receptacle. As such, unintentional release is prevented.

The axial groove may be configured to guide a component latching portion of the subsea equipment in the axial direction.

The axial groove may be configured to receive the component latching portion and, when the component latching portion is in an axial end position of the axial groove, the component latching portion may be configured to be guided along the ramp until the component locking portion enters the detent, such that the component latching surface abuts the receptacle latching surface thereby latching the subsea equipment to the subsea receptacle both in the axial direction and in the circumferential direction.

The axial groove may have an extension in the circumferential direction that is at least 1.5 times an extension in the circumferential direction of the component latching portion.

The receptacle latching surface may be configured to interact with a component latching surface of the component latching portion of the subsea equipment to counteract relative axial movement between the subsea receptacle and the subsea equipment.

When interacting, the component latching surface and the subsea receptacle latching surface take up axial forces.

The subsea receptacle may comprise a pin guide for guiding an alignment pin of the subsea equipment.

When moving the subsea equipment into the subsea receptacle, the alignment pin and the pin guide provide a first coarse alignment of the subsea equipment relative the subsea receptacle. Then, since the alignment pin is guided in the pin guide, it is ensured that the component latching portion enters the axial groove correctly.

The subsea receptacle may be an electric actuator receptacle.

The electric actuator receptacle may be mounted on a subsea electric Xmas tree. The subsea Xmas tree may be an electric subsea tree, also referred to as an electric tree or an all-electric subsea tree within the oil and gas industry, which is characterized in that it is electrically operated and that a traditional umbilical with a hydraulic fluid line as used in the oil and gas industry is superfluous because the operation of the valves in the electric subsea tree is done by electric communication/power only.

The subsea receptacle may be configured to be secured to a subsea Xmas tree.

The present invention also relates to a subsea system comprising:

a subsea equipment as defined above; and a subsea receptacle as defined above.

The subsea equipment may comprise one latching arrangement and the subsea receptacle may comprise one axial groove and receptacle latching portion.

Alternatively, the subsea equipment may comprise two latching arrangements and the subsea receptacle may comprise two axial grooves and receptacle latching portions. Two or more of each arranged at fixed intervals is a preferable choice due to load distribution etc.

Alternatively, the subsea equipment may comprise three, four or more latching arrangements and the subsea receptacle may comprise three, four or more axial grooves and receptacle latching portions.

The equipment and the subsea receptacle are preferably cylindrical such that the equipment can be received within the subsea receptacle. When the equipment is received within the subsea receptacle it is rotatable relative the subsea receptacle.

The subsea equipment may be an electric actuator and the subsea receptacle may be an electric actuator receptacle.

Alternatively, the equipment can be a subsea connector and the subsea receptacle can be a subsea connector receptacle. It is clear the subsea equipment and the subsea receptacle can form part of other subsea systems where latching of equipment into a receptacle is required.

The present invention also relates to a method of mounting a subsea equipment as defined above to a subsea receptacle as defined above, the method comprising:

a first step of moving the subsea equipment in the axial direction into the subsea receptacle;

a second step of rotating the latching arrangement of the subsea equipment in the circumferential direction which may be orthogonal to the axial direction such as to latch the subsea equipment to the subsea receptacle both in the axial direction and in the circumferential direction.

The described invention has at least some of the following advantages:

clear visible indication that the equipment is locked in place, allow for easy latching/unlatching so equipment can be replaced or inspected subsea, able to withstand forces from Remotely Operated Vehicle (ROV) manipulation, able to withstand forces from installation and transportation provides positive locking.

Above-discussed preferred and/or optional features of each aspect of the invention/disclosure may be used, alone or in appropriate combination, in the other aspects of the invention/disclosure.

The claimed invention is specified in the independent claims of this application. Advantageous adaptations and versions of the claimed invention are specified in the independent claims.

DESCRIPTION OF THE DRAWINGS

Following drawings are appended to facilitate the understanding of the claimed invention:

FIG. 3A shows that the subsea equipment is about to enter the subsea receptacle in the axial direction, FIG. 3B shows that the subsea equipment has entered the subsea receptacle but the subsea equipment is not latched to the subsea receptacle, and FIG. 3C shows that the subsea equipment has latched to the subsea receptacle;

Figure 1:
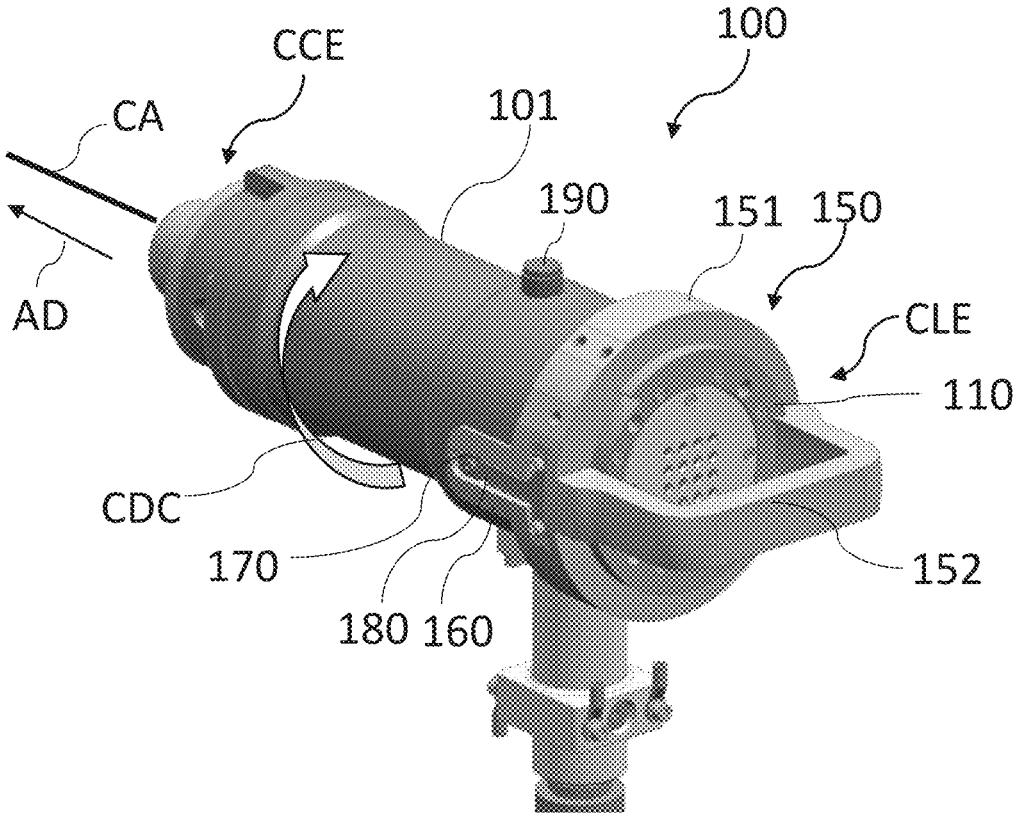
FIG. 1 is a perspective view of a subsea equipment according to the invention.

It should be understood, however, that the drawings are not intended to limit the claimed invention to the subject-matter depicted in the drawings.

In the drawings, like reference numerals have been used to indicate common parts, elements or features unless otherwise explicitly stated or implicitly understood by the context.

DETAILED DESCRIPTION

In the following, one or more specific embodiments of the invention will be described in more detail with reference to the drawings. However, it is specifically intended that the invention is not limited to the embodiments and illustrations contained herein but includes modified forms of the embodiments including portions of the embodiments and combinations of elements of different embodiments as come within the scope of the following claims. It should be appreciated that in the development of any such actual implementation, as in any engineering or design project, numerous implementation-specific decisions must be made to achieve the developer's specific goals, such as compliance with system and/or business-related constraints, which may vary from one implementation of the invention to another. Moreover, it should be appreciated that such a development effort might be complex and time consuming, but would nevertheless be a routine undertaking of design, fabrication and manufacture for the skilled person having the benefit of this disclosure.

FIG. 1 is a perspective view of a subsea equipment 100 according to the invention. The subsea equipment 100 is configured to be mounted in a subsea receptacle 200 (subsea receptacle not shown in FIG. 1, see e.g. FIG. 2). The subsea equipment 100 comprises a component body 101 configured to be received inside the subsea receptacle 200. The component body 101 extends, along a component axis CA, in an axial direction AD, between a connecting end CCE and a locking end CLE, and in a circumferential direction CDC about the component axis CA. In FIG. 1, the component body 101 has a cylindrical shape such that the circumferential direction CDC is along a circle orthogonal to the axial direction AD.

The subsea equipment 100 in the figures is shown as an electric actuator.

The component body 101 further comprises a latching arrangement 150 connected to the locking end CLE of the component body 101. The latching arrangement 150 is configured to rotate in the circumferential direction CDC orthogonal to the axial direction AD.

The latching arrangement 150 features a rotatable portion 151, a component latching portion 160 extending in the axial direction AD, a component locking portion 170 and a spring 180 biasing the component locking portion 170 in a radial direction.

The rotatable portion 151 is rotatably connected to the component body 101. The rotatable portion 151 is disclosed as being arranged at the locking end CLE and circumferentially enclosing a portion of the component body 101.

The component latching portion 160 is disclosed to be in the form of fingers extending in the axial direction AD extending from the rotatable portion 151, in the axial direction AD, towards the connecting end CCE.

The component latching portion 160 comprises (not shown in FIG. 1, see e.g. FIG. 7A-7C) a component latching surface 161 extending in the circumferential direction CDC and facing towards said locking end CLE. The component latching portion 160 is configured to be guided in an axial groove 260 (not shown in FIG. 1, see e.g. FIG. 2) of the subsea receptacle 200.

The component locking portion 170 is shown to be in the form of a locking block configured to interact with a detent 220 (not shown in FIG. 1, see e.g. FIG. 2) of the subsea receptacle 200 to counteract relative rotation between the latching arrangement 150 and the subsea receptacle 200 in the circumferential direction CDC.

The spring 180 in the example in FIG. 1 biases the component locking portion 170 in a radial direction, wherein the radial direction is orthogonal to the circumferential direction CDC. In the example in FIG. 1 the spring 180 biases the component locking portion 170 radially inwards.

The component body 101 thus has a component axis CA along which it is extending and the circumferential direction CDC is about the component axis CA. In other words, the circumferential direction CDC may be seen to extend in a plane which is concentrically arranged about the component axis CA.

The component latching portion 160 provides axial retention or resistance, i.e. axial stop features, and rotational retention, i.e. rotational stop features, of the subsea equipment 100, whereas the spring 180 only provides rotational resistance of the equipment 100.

Figure 2:
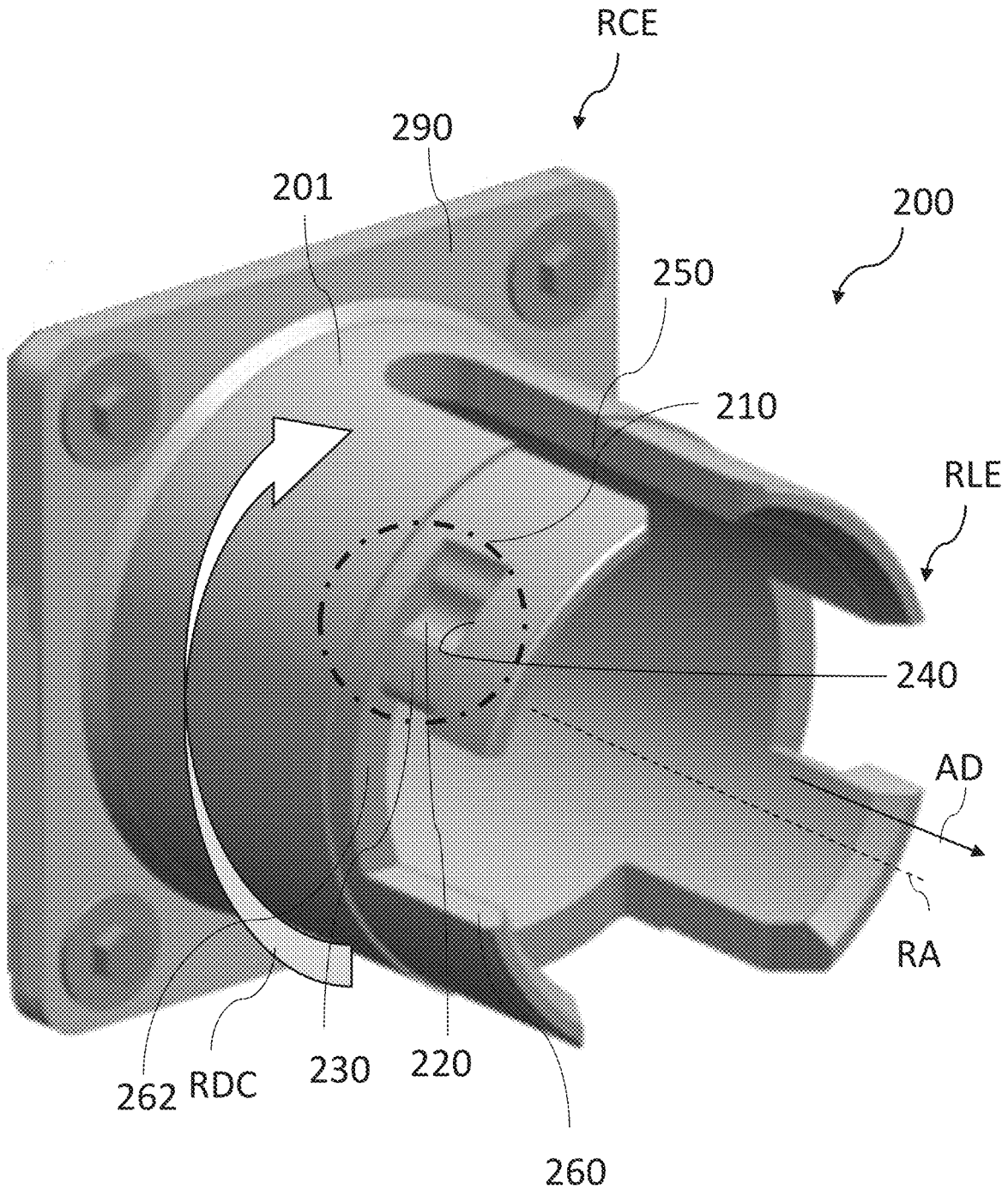
FIG. 2 is a perspective view of a subsea receptacle according to the invention.
Figure 4:
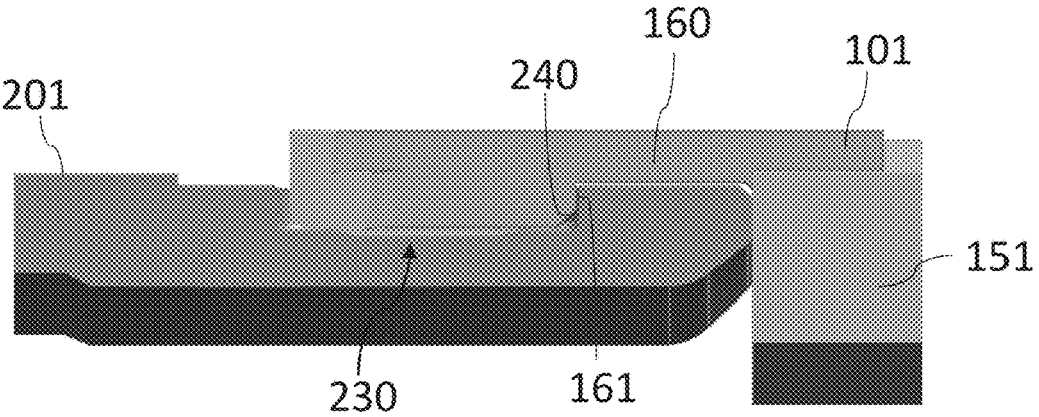
FIG. 4 is a cross-sectional view taken along the axial direction showing details of surfaces of the subsea receptacle and the component latching portion providing axial retention of the subsea equipment relative the subsea receptacle.

The component latching surface 161 of the component latching portion 160 is configured to interact with an oppositely oriented receptacle latching surface 240 on the subsea receptacle 200 (see e.g. FIG. 2 or 4). The properties of the component latching portion 160 can be tuned to provide more or less axial resistance by tweaking the cross-sectional area or length.

The latching arrangement 150 is further provided with a handle 152. The handle 152 is disclosed as being connected to the rotatable portion 151 of the latching arrangement 150 such that the rotatable portion 151 rotates together with the handle 152. Further details of the handle 152 will be described below in relation to FIGS. 7A-7C. The handle 152 provides an interface for manipulation by e.g. ROV. Geometry of the handle 152 could be modified to have other interfaces for direct handling by ROV.

The handle 152 may comprise visual marking to show angular position of the subsea equipment 100 relative to receptacle 200. The visual marking may be in the form of number of degrees rotated relative the subsea receptacle or other types of visual marking.

The handle 152 may serve as an attachment for the spring 180 and the component locking portion 170.

When the handle 152 contacts the subsea receptacle 200, it may provide a stop for movement of the subsea equipment 100 relative the subsea receptacle 200 in the axial direction AD.

As shown in FIG. 1, the component body 101 comprises an alignment pin 190 configured to guide the component body 101 into the subsea receptacle 200. The alignment pin 190 angularly aligns the subsea equipment's 100 radial features so it can be installed into the subsea receptacle 200. Furthermore, the alignment pin 190, together with a pin guide 250 of the subsea receptacle 200 (not shown in FIG. 1, see. FIG. 2) may lock the component body's 101 rotational orientation to the subsea receptacle 200, which provides a torque path to allow the handle 152 to rotate independently from the component body 101.

The alignment pin 190 may form a leading feature to prevent the component latching portion 160 from crashing into receptacle 200 if the subsea equipment 100 is not correctly aligned.

FIG. 2 is a perspective view of a subsea receptacle 200 according to the invention.

The subsea receptacle 200 is configured to receive a subsea equipment 100, e.g. a subsea equipment 100 as described in relation to FIG. 1. The subsea receptacle 200 comprises a receptacle body 201. The receptacle body 201 is disclosed as being connected to a connection plate 290 to e.g. a Xmas tree.

The receptacle body 201 comprises an axial groove 260 and a receptacle latching portion 210.

The receptacle body 201 is configured to receive the subsea equipment 100 therein. The subsea receptacle body 201 extends, along a receptacle axis RA, in an axial direction AD, between a receptacle connecting end RCE and a receptacle locking end RLE, and in a circumferential direction RDC about the subsea receptacle axis RA. The subsea receptacle body 201 thus has a CA receptacle axis RA along which it is extending and the circumferential direction RDC is about the subsea receptacle axis RA. In other words, the circumferential direction RDC may be seen to extend in a plane which is concentrically arranged about the subsea receptacle axis. The subsea receptacle body 201 in FIG. 2 has a cylindrical shape such that the circumferential direction RDC is along a circle.

The axial groove 260 extends in the axial direction AD, from the subsea receptacle connecting end RCE, and terminates in a stop end 262. The axial groove 260 is configured to guide the component latching portion 160 of the subsea equipment 100 in the axial direction AD.

The receptacle latching portion 210 extends in the circumferential direction RDC from the stop end 262. The receptacle latching portion 210 comprises a receptacle latching surface 240 facing towards the subsea receptacle connecting end RCE. The receptacle latching portion 210 further comprises a detent 220 and a ramp 230.

The detent 220 is configured to interact with a component locking portion 170 of the latching arrangement 150 of the subsea equipment 100 (as described in relation to FIG. 1) to counteract relative rotation between the latching arrangement 150 and the subsea receptacle 200 in the circumferential direction RDC.

The ramp 230 extends in the circumferential direction RDC, between the stop end 262 and the detent 220, to guide the component locking portion 170 of the latching arrangement 150 towards the detent 220. Further details of the ramp 230 are described in relation to FIG. 5 below.

The axial groove 260 is configured to receive the component latching portion 160 and, when the component latching portion 160 is in an axial end position of the axial groove 260, the component latching portion 160 is configured to be guided along the ramp 230 until the component locking portion 170 enters the detent 220, such that the component latching surface 161 abuts the receptacle latching surface 240 thereby latching the subsea equipment 100 to the subsea receptacle 200 both in the axial direction AD and in the circumferential direction CDC. The receptacle latching surface 240 is thus configured to interact with the component latching surface 161 of the component latching portion 160 of the subsea equipment 100 to counteract relative axial movement between the subsea receptacle 200 and the subsea equipment 100. When interacting, the component latching surface 161 and the subsea receptacle latching surface 240 take up axial forces.

The subsea receptacle 200 comprises a pin guide 250 for guiding an alignment pin 190 of the subsea equipment 100.

When moving the subsea equipment 100 into the subsea receptacle 200, the alignment pin 190 and the pin guide 250 provide a first coarse alignment of the subsea equipment 100 relative the subsea receptacle 200. Then, since the alignment pin 190 is guided in the pin guide 250 it is ensured that the component latching portion 160 enters the axial groove 260 correctly.

The subsea receptacle 200 disclosed in the figures is shown as an electric actuator receptacle.

Referring to FIGS. 1 and 2, the rotational retention of the component latching portion 160 may ensure that the component locking portion 170 is positioned in the detent 220, i.e. that the component locking portion 170 is prevented from moving past the detent 220 upon rotating the latching arrangement 150 relative the subsea receptacle 200.

The force required to deflect the spring 180 and the component locking portion 170 over the detent 220 provides the anti-rotation properties of the latching arrangement 150. The amount of anti-rotation can be tuned by changing either the deflection properties of the spring, such as cross-sectional area or length, or by changing the detent entry angle and height, such as features of a ramp 230 as described below.

The axial groove 260 is configured to guide a component latching portion 160 of the subsea equipment 100 in the axial direction AD. The axial groove 260 is configured to receive the component latching portion 160 and, when the component latching portion 160 is in an axial end position of the axial groove 260, the component latching portion 160 is configured to be guided along a ramp 230 until the component locking portion 170 enters the detent 220, such that the component latching surface 161 abuts the receptacle latching surface 240 thereby latching the subsea equipment 100 (see subsea equipment 100 in FIG. 1) to the subsea receptacle 200 both in the axial direction AD and in the circumferential direction CDC.

Figure 3A:
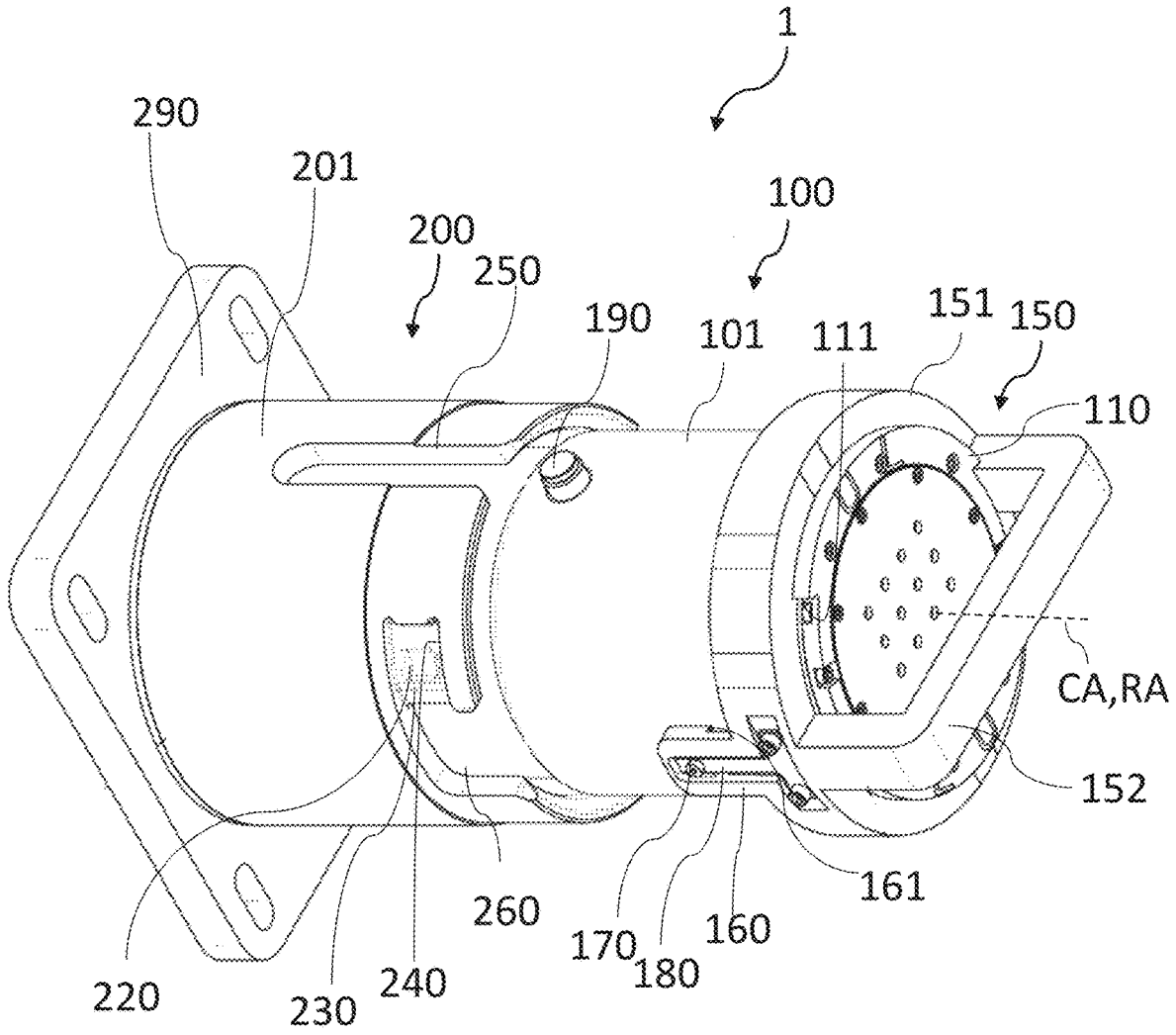
FIGS. 3A-3C show different time lapse views of the subsea equipment connecting and latching to the subsea receptacle, where
Figure 3B:
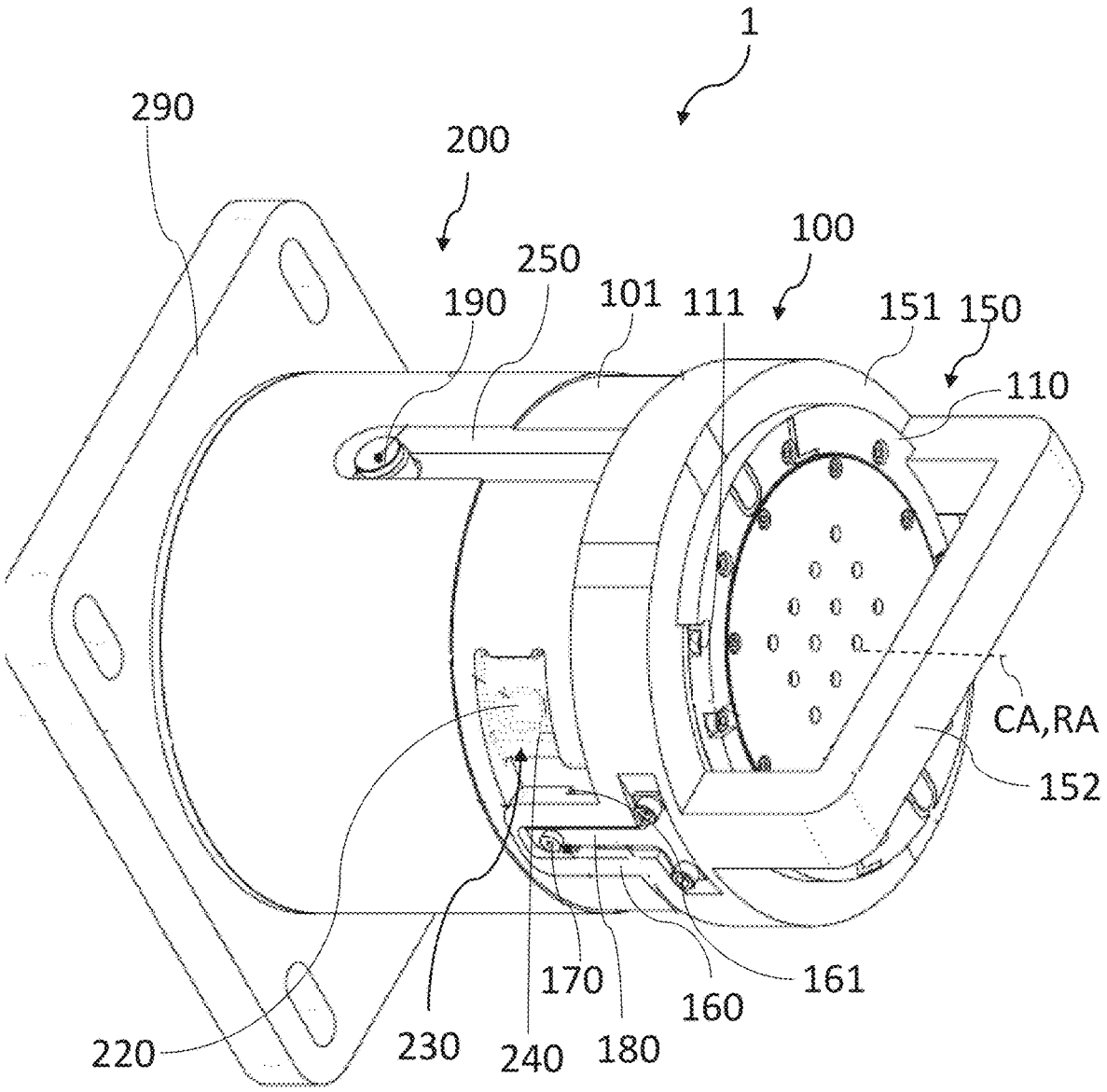
Figure 3C:
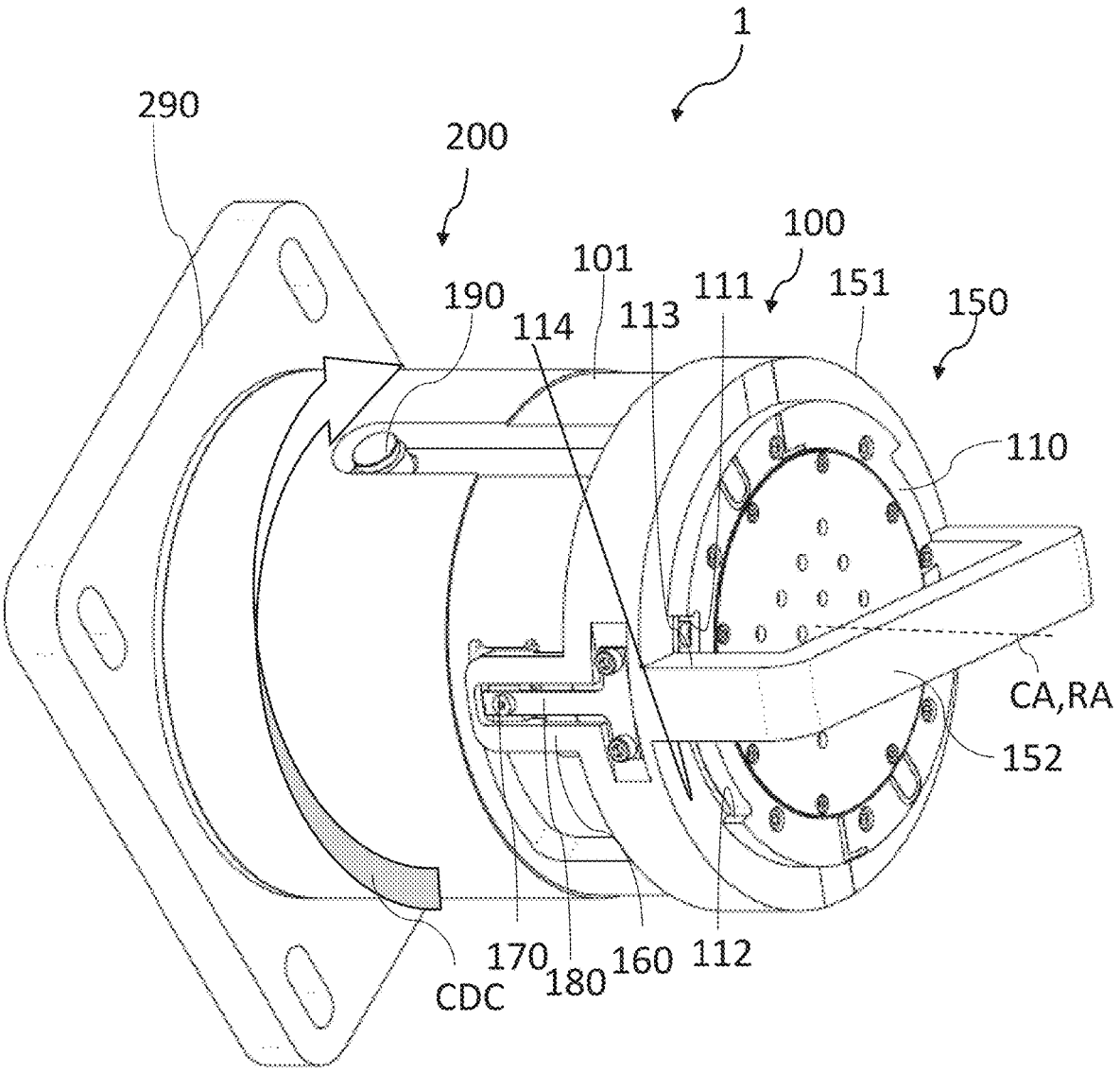

FIGS. 3A-3C show different time lapse views of the subsea equipment 100 connecting and latching to the subsea receptacle 200, where FIG. 3A shows that the subsea equipment 100 is about to enter the subsea receptacle 200 in the axial direction, FIG. 3B shows that the subsea equipment 100 has entered the subsea receptacle 200 but the subsea equipment 100 is not latched to the subsea receptacle 200, and FIG. 3C shows that the subsea equipment 100 has latched to the subsea receptacle 200. The subsea component 100 and the subsea receptacle 200 in FIGS. 3A-3C together form a subsea system 1. The subsea component 100 of the subsea system 1 can be (as shown) an electric actuator and the subsea receptacle 200 of the subsea system 1 can be (as shown) an electric actuator receptacle.

Referring to FIG. 3A, the subsea equipment 100 is disclosed with a retention device 110 connecting the latching arrangement 150 to the component body 101. The retention device 110 is configured to prevent axial movement of the latching arrangement 150 relative to the component body 101 and to allow rotational movement of the latching arrangement 150 relative to the component body 101. The retention device 110 may be bolted, or otherwise securely fastened, to the component body 101. The retention device 110 may comprise visual marking to show angular position.

The retention device 110 features a first stop surface 111 and a second stop surface 112. and the rotatable portion 151 comprises complementary first and second stop surfaces 113,114 for interaction with the first stop surface 111 and the second stop surface 112 of the retention device 110.

The distance between the first and second stop surfaces 111,112 of the retention device 110 defines the maximum allowable rotational movement of the rotatable portion 151, i.e. the first and second stop surfaces 111,112 serve as angular limit stops for rotatable portion 151 and thus the handle 152. This is equal to a maximum number of degrees of rotation for the rotatable portion 151. Normally, the number of degrees of rotation for the rotatable portion 151 is larger than the required number of degrees when moving between an unlatched position and a latched position, i.e. for the component latching portion 160 of the latching arrangement to move from a position within the axial groove 260 of the subsea receptacle 200 to a position where the component locking portion 170 interact with the detent 220.

When comparing the position of the subsea equipment 100 relative the subsea receptacle 200 in FIG. 3B with FIG. 3A, it can be seen that the subsea equipment 100 has been completely received in the subsea receptacle 200. In other words, subsea equipment 100 has moved axially into the subsea receptacle 200. The alignment pin 190 is positioned in the pin guide 250 and the component latching portion 160 is positioned in the axial groove 260. However, but the subsea equipment 100 is not latched to the subsea receptacle 200.

When comparing the position of the subsea equipment 100 relative the subsea receptacle 200 in FIG. 3C with FIG. 3B, the subsea equipment 100 has latched to the subsea receptacle 200 in that the component locking portion 170 is arranged in the detent 220. This has been achieved by rotating the handle 152 in the clockwise direction.

When unlatching the subsea component 100 from the subsea receptacle 200, the handle 152 is rotated in the counter clockwise direction.

Referring to FIGS. 3A-3C, a method of mounting a subsea equipment 100 to a subsea receptacle 200 may comprise:

- a first step of moving the subsea equipment 100 in the axial direction AD into the subsea receptacle 200;
- a second step of rotating the latching arrangement 150 of the subsea equipment 100 in the circumferential direction CDC which is orthogonal to the axial direction AD such as to latch the subsea equipment 100 to the subsea receptacle 200 both in the axial direction AD and in the circumferential direction CDC.

FIG. 4 is a cross-sectional view taken along the axial direction showing details of surfaces of the subsea receptacle 200 and the component latching portion 160 providing axial retention of the subsea equipment 100 relative the subsea receptacle 200.

Additionally, the component latching portion 160 may comprise chamfer features that will allow e.g. a Remotely Operated Vehicle ROV (not shown) to overpull with an emergency load to unlatch a stuck subsea equipment 100 from the subsea receptacle 200. The overpull load will open the component latching portion 160 up and allow the equipment to be released. This load is also dictated by the cross-sectional area and length of the component latching portion 160.

Figure 5:
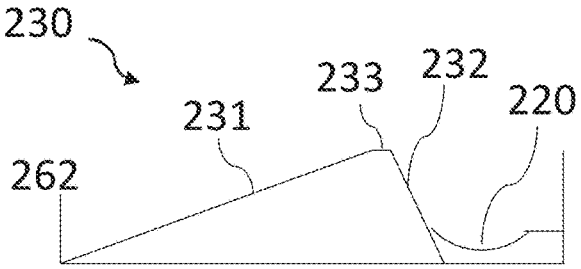
FIG. 5 shows details of a ramp of the subsea receptacle for cooperating with a component latching portion and component locking portion of the subsea equipment during latching of the subsea equipment to the subsea receptacle.

FIG. 5 shows details of a ramp 230 of the subsea receptacle 200 for cooperating with a component latching portion 160 and component locking portion 170 of the subsea equipment 100 during latching of the subsea equipment 100 to the subsea receptacle 200.

The ramp 230 comprises a first ramp surface 231, a second ramp surface 232 and a transition zone 233 between the first ramp surface 231 and the second ramp surface 232. The first ramp surface 231 extends from the stop end 262 to a transition zone 233, and the second ramp surface 232 extends from the transition zone 233 to the detent 220.

A thickness of the first ramp surface 231 is disclosed as increasing from the stop end 262 towards the transition zone 233 and a thickness of the second ramp surface 232 decreases from the transition zone 233 towards the detent 220.

The second ramp surface 232 is disclosed as being steeper than the first ramp surface 231.

This is advantageous in that a larger force is required to release the subsea equipment 100 from the subsea receptacle 200 than to latch the subsea equipment 100 to the subsea receptacle 200. As such, unintentional release is prevented.

Figure 6:
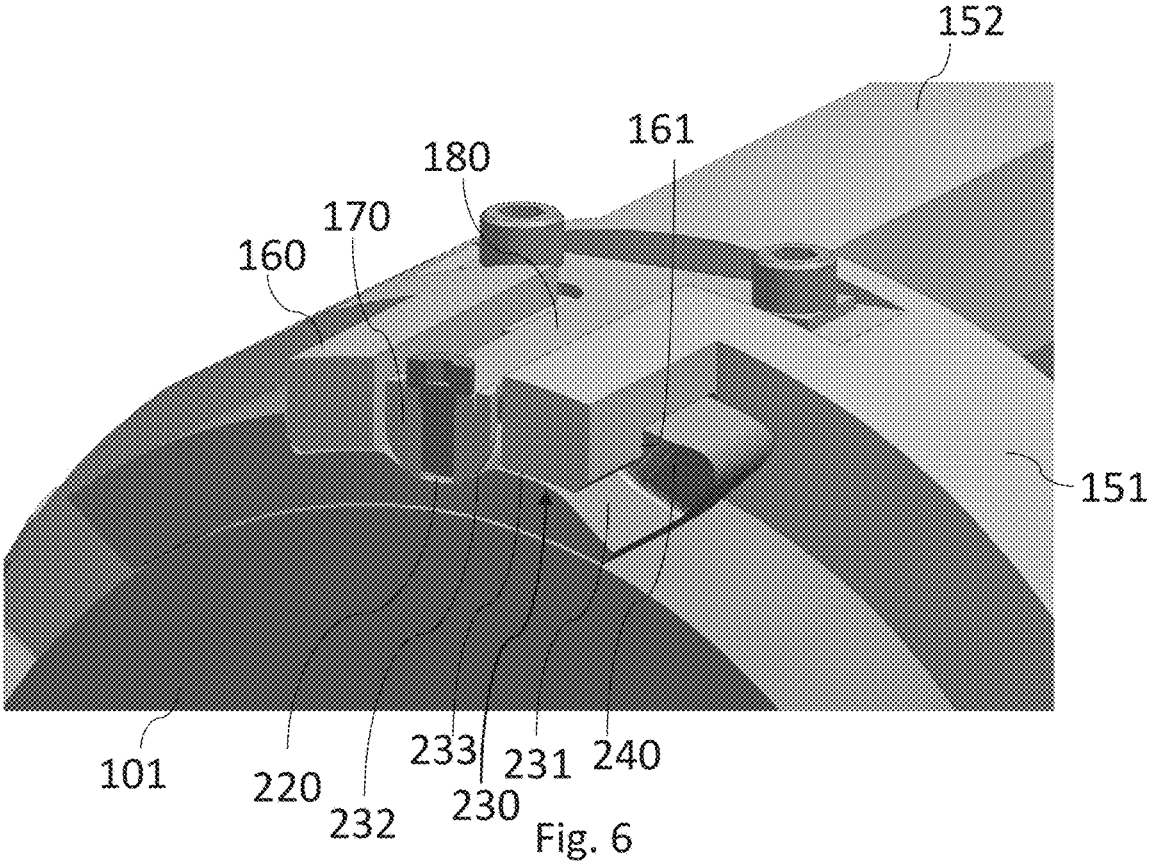
FIG. 6 is a cross-sectional view in a plane perpendicular to the axial direction taken at a component locking portion of the subsea equipment showing the subsea equipment latched to the subsea receptacle (similar to the situation in FIG. 3C)

FIG. 6 is a cross-sectional view in a plane perpendicular to the axial direction taken at a component locking portion 170 of the subsea equipment 100 showing the subsea equipment 100 latched to the subsea receptacle 200 (similar to the situation in FIG. 3C).

Figure 7A:
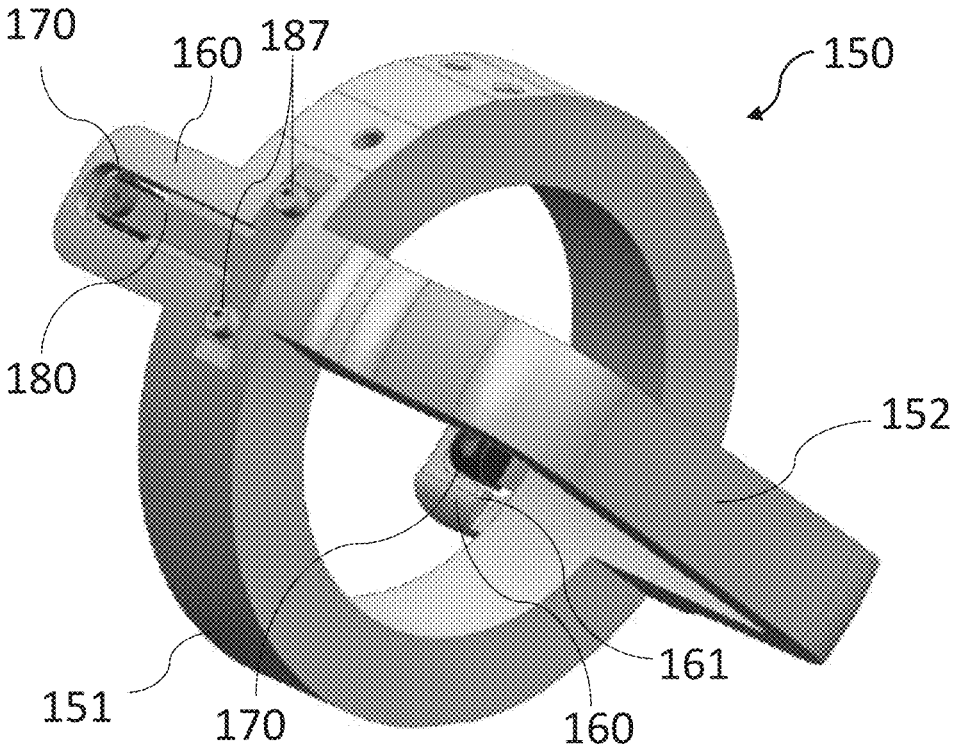
FIG. 7A is a side perspective view showing details of a latching arrangement of the subsea equipment, including a component latching surface of the component latching portion and a spring biasing the component locking portion in a radial direction.

FIG. 7A is a side perspective view showing details of a latching arrangement 150 of the subsea equipment 100, including a component latching surface 161 of the component latching portion 160 and a spring 180 biasing the component locking portion 170 in a radial direction. In the disclosed embodiment, two component latching portions 160 are disclosed, arranged on opposite sides of the latching arrangement 150.

The handle 152 provides an interface for manipulation by e.g. ROV. Geometry of the handle 152 could be modified to have other interfaces for direct handling by ROV.

The handle 152 may comprise visual marking to show angular position of the subsea equipment 100 relative to receptacle 200. The visual marking may be in the form of number of degrees rotated relative the subsea receptacle or other types of visual marking.

The handle 152 may serve as an attachment for the spring 180 and the component locking portion 170.

The spring 180 in FIG. 7A is arranged such that it is external relative to the detent. As such, it biases inwardly in the radial direction towards the detent when the subsea equipment 100 is latched to the subsea receptacle 200 (as shown in FIG. 3C). An advantage of arranging the spring 180 externally relative to the detent is that it is visible from the outside and thus easier accessible. By use of e.g. a ROV, one may then visibly verify that the component locking portion 170 is properly positioned in the detent 220.

Figure 7B:
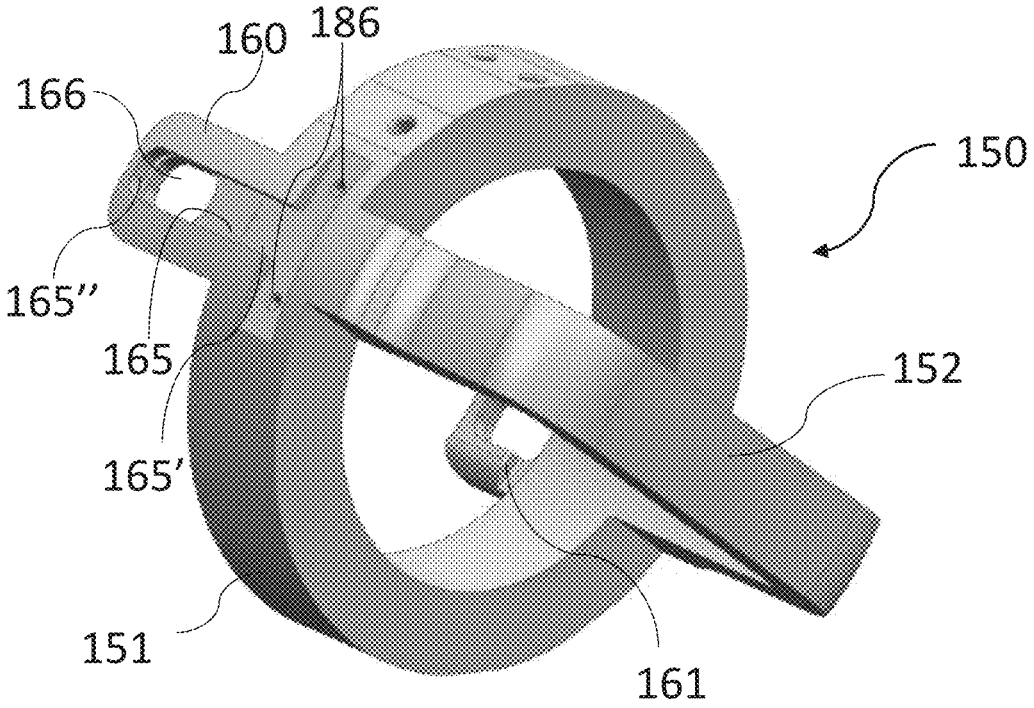
FIG. 7B is a similar view as FIG. 7A, but where the spring and the component locking portion have been omitted on purpose to better illustrate a spring groove of the latching arrangement.

FIG. 7B is a similar view as FIG. 7A, but where the spring 180 and the component locking portion 170 have been omitted on purpose to better illustrate a spring groove 165 of the latching arrangement 150. The groove 165 and the spring 180 will preferably be of complementary shape such that the spring 180 fits inside the groove 185. The groove 15 is disclosed with two connection holes 186 for securing the spring 180 to the rotatable portion 151 using known fastening means 187 such as e.g. screw, pin, bolt etc. (see FIG. 7A). The groove 165 features a first part 165' relatively closer to the rotatable portion 151 and a second part 165" relatively further away from the rotatable portion 151. The first part 165' of the groove 165 has a material thickness whereas the second part 165" of the groove 165 is formed of a through-going hole 166. The through-going hole 166 is sized to accommodate the component locking portion 170.

Figure 7C:
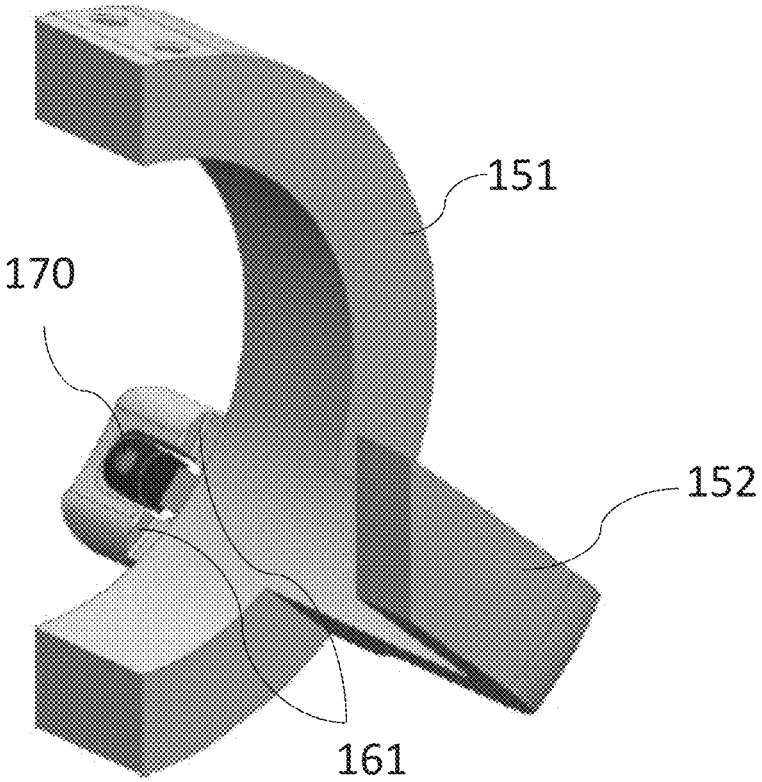
FIG. 7C is a similar view as FIG. 7A but where half of the latching arrangement has been removed on purpose to better illustrate the component locking portion and the component latching surface of the component latching portion.
Figure 7D:
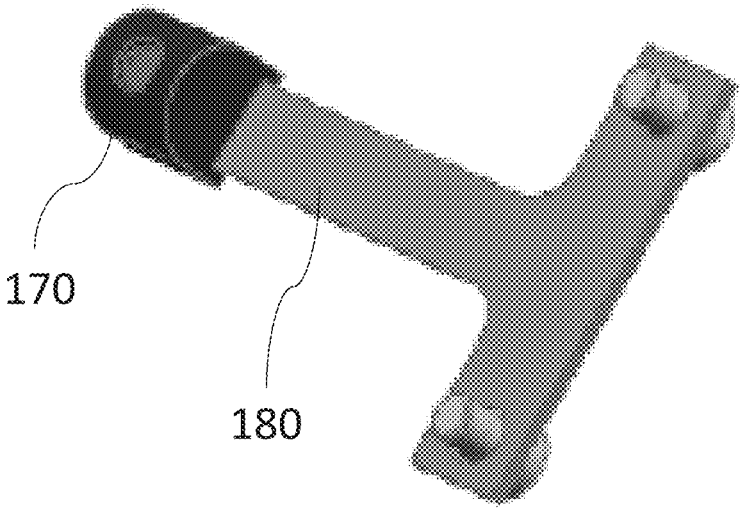
FIG. 7D shows details of the spring and the component locking portion of the latching arrangement in FIGS. 7A and 7C.

FIG. 7D shows details of the spring 180 and the component locking portion 170 of the latching arrangement in FIGS. 7A and 7C. The spring 180 in FIG. 7D is exemplified as a blade spring, the spring 180 comprising a first end which is configured to be rigidly attached to the rotatable portion 151 via e.g. fastening means 187 and a second end to which said component locking portion 170 is attached. The disclosed spring 180 is T-shaped, however other shapes is also possible depending on requirements and available space.

In the preceding description, various aspects of the subsea equipment and the subsea receptacle according to the invention have been described with reference to the illustrative embodiment. For purposes of explanation, specific numbers, systems and configurations were set forth in order to provide a thorough understanding of the apparatus and its workings. However, this description is not intended to be construed in a limiting sense. Various modifications and variations of the illustrative embodiment, as well as other embodiments of the subsea equipment and the subsea receptacle, which are apparent to person skilled in the art to which the disclosed subject-matter pertains, are deemed to lie within the scope of the present invention as defined by the following claims.

LIST OF REFERENCE NUMBERS

1 subsea system
100 subsea component
101 component body
110 retention device
111 first stop surface
112 second stop surface
113 first stop surface of rotatable portion
114 second stop surface of rotatable portion
150 latching arrangement
151 rotatable portion
152 handle
160 component latching portion
161 component latching surface
165 groove
165' first part of groove 165
165" second part of groove 165
166 through-going hole
170 component locking portion
180 spring
185 spring groove
186 connection hole
187 fastening means
190 alignment pin
200 receptacle
210 receptacle latching portion
220 detent
230 ramp
231 first ramp surface
232 second ramp surface
233 transition zone
240 receptacle latching surface
250 pin guide
260 axial groove
262 stop end
290 connection plate
AD axial direction
CA component axis
CDC circumferential direction (of connector)
RA receptacle axis
RDC circumferential direction (of receptacle)
CCE connecting end
CLE locking end
RCE receptacle connecting end
RLE receptacle locking end

The invention claimed is:

1. A subsea equipment configured to be mounted in a subsea receptacle, the subsea equipment comprising:
- a component body configured to be received inside the subsea receptacle, the component body extending along a component axis (CA) in an axial direction (AD) between a connecting end (CCE) and a locking end (CLE) and in a circumferential direction (CDC) about the component axis (CA), the circumferential direction (CDC) being orthogonal to the axial direction (AD);
- a latching arrangement connected to the locking end (CLE) of the component body and being configured to rotate in the circumferential direction (CDC), the latching arrangement comprising:
  - a rotatable portion rotatably connected to the component body;
  - a component latching portion extending from the rotatable portion in the axial direction (AD) towards the connecting end (CCE) and comprising a component latching surface extending in the circumferential direction (CDC) and facing towards said locking end (CLE);
  - a component locking portion configured to interact with a detent of the subsea receptacle to counteract relative rotation between the latching arrangement and the subsea receptacle in the circumferential direction (CDC); and
  - a spring biasing the component locking portion in a radial direction orthogonal to the circumferential direction (CDC).

2. The subsea equipment according to claim 1, wherein the rotatable portion circumferentially encloses at least a portion of the component body.

3. The subsea equipment according to claim 1, wherein the latching arrangement comprises a handle.

4. The subsea equipment according to claim 1, wherein said spring is configured to bias the component locking portion towards the component body.

5. The subsea equipment according to claim 1, wherein the component body comprises an alignment pin configured to guide the component body into the subsea receptacle.

6. The subsea equipment according to claim 1, wherein said component latching portion comprises a groove inside which said spring is arranged.

7. The subsea equipment according to claim 1, wherein said spring is a blade spring comprising a first end which is rigidly attached to the rotatable portion and a second end to which said component locking portion is attached.

8. The subsea equipment according to claim 1, wherein the subsea equipment comprises a retention device connecting the latching arrangement to the component body, and wherein the retention device is configured to prevent axial movement of the latching arrangement relative to the component body and to allow rotational movement of the latching arrangement relative to the component body.

9. The subsea equipment according to claim 8, wherein the retention device comprises a first stop surface and a second stop surface, and wherein the rotatable portion comprises complementary first and second stop surfaces for interaction with the first stop surface and the second stop surface of the retention device.

10. The subsea equipment according to claim 1, wherein the subsea equipment is an electric actuator.

11. A subsea receptacle configured to receive a subsea equipment, the subsea receptacle comprising:

a receptacle body configured to receive the subsea equipment therein, the receptacle body extending along a receptacle axis (RA) in an axial direction (AD) between a receptacle connecting end (RCE) and a receptacle locking end (RLE) and in a circumferential direction (RDC) about the receptacle axis (RA), the receptacle body comprising:

an axial groove extending in the axial direction (AD) from the subsea receptacle connecting end (RCE) and terminating in a stop end;

a receptacle latching portion extending in the circumferential direction (RDC) from the stop end, wherein the receptacle latching portion comprises:

a receptacle latching surface facing towards the receptacle connecting end (RCE);

a detent configured to interact with a component locking portion of a latching arrangement of the subsea equipment to thereby counteract relative rotation between the latching arrangement and the subsea receptacle in the circumferential direction; and a ramp extending in the circumferential direction (RDC) between the stop end and the detent to guide the component locking portion of the latching arrangement towards the detent.

12. The subsea receptacle according to claim 11, wherein the ramp comprises a first ramp surface, a second ramp surface and a transition zone between the first ramp surface and the second ramp surface, and wherein the first ramp surface extends from the stop end to the transition zone and the second ramp surface extends from the transition zone to the detent.

13. The subsea receptacle according to claim 12, wherein a thickness of the first ramp surface increases from the stop end towards the transition zone and a thickness of the second ramp surface decreases from the transition zone towards the detent.

14. The subsea receptacle according to claim 13, wherein the second ramp surface is steeper than the first ramp surface.

15. The subsea receptacle according to claim 11, wherein the axial groove is configured to guide a component latching portion of the subsea equipment in the axial direction (AD).

16. The subsea receptacle according to claim 11, wherein the receptacle latching surface is configured to interact with a component latching surface of a component latching portion of the subsea equipment to thereby counteract relative axial movement between the subsea receptacle and the subsea equipment.

17. The subsea receptacle according to claim 11, further comprising a pin guide for guiding an alignment pin of the subsea equipment.

18. The subsea receptacle according to claim 11, wherein the subsea receptacle is an electric actuator receptacle.

19. The subsea receptacle according to claim 11, wherein the subsea receptacle is configured to be secured to a subsea Xmas tree.

20. A subsea system comprising:

a subsea equipment; and a subsea receptacle;

wherein the subsea equipment comprises:

a component body configured to be received inside the subsea receptacle, the component body extending along a component axis (CA) in an axial direction (AD) between a component connecting end (CCE) and a component locking end (CLE) and in a circumferential direction (CDC) about the component axis (CA), the circumferential direction (CDC) being orthogonal to the axial direction (AD); and a latching arrangement connected to the component locking end (CLE) and being configured to rotate in the circumferential direction (CDC), the latching arrangement comprising a rotatable portion rotatably connected to the component body, a component latching portion extending from the rotatable portion in the axial direction (AD) towards the component connecting end (CCE) and comprising a component latching surface extending in the circumferential direction (CDC) and facing towards said component locking end (CLE), a component locking portion, and a spring biasing the component locking portion in a radial direction orthogonal to the circumferential direction (CDC);

wherein the subsea receptacle comprises:

a receptacle body configured to receive the subsea equipment therein, the receptacle body extending along a receptacle axis (RA) in the axial direction (AD) between a receptacle connecting end (RCE) and a receptacle locking end (RLE) and in a circumferential direction (RDC) about the receptacle axis (RA), the receptacle body comprising:

an axial groove extending in the axial direction (AD) from the subsea receptacle connecting end (RCE) and terminating in a stop end; and a receptacle latching portion extending in the circumferential direction (RDC) from the stop end, the receptacle latching portion comprising a receptacle latching surface facing towards the receptacle connecting end (RCE), a detent configured to interact with the component locking portion of the latching arrangement of the subsea equipment to thereby counteract relative rotation between the latching arrangement and the subsea receptacle in the circumferential direction, and a ramp extending in the circumferential direction (RDC) between the stop end and the detent to guide the component locking portion of the latching arrangement towards the detent;

wherein the component latching surface is configured to interact with the receptacle latching surface to thereby counteract relative axial movement between the subsea receptacle and the subsea equipment.

21. The subsea system according to claim 20, wherein the subsea equipment is an electric actuator and the subsea receptacle is an electric actuator receptacle.

22. The subsea system according to claim 20, wherein the latching arrangement comprises a handle.

23. The subsea system according to claim 20, wherein said spring is configured to bias the component locking portion towards the component body.

24. The subsea system according to claim 20, wherein the component body comprises an alignment pin configured to guide the component body into the subsea receptacle.

25. The subsea system according to claim 20, wherein the subsea equipment comprises a retention device connecting the latching arrangement to the component body, and wherein the retention device is configured to prevent axial movement of the latching arrangement relative to the component body and to allow rotational movement of the latching arrangement relative to the component body.

26. The subsea system according to claim 25, wherein the retention device comprises a first stop surface and a second stop surface, and wherein the rotatable portion comprises complementary first and second stop surfaces for interaction with the first stop surface and the second stop surface of the retention device.

27. The subsea system according to claim 20, wherein the ramp comprises a first ramp surface, a second ramp surface and a transition zone between the first ramp surface and the second ramp surface, and wherein the first ramp surface extends from the stop end to the transition zone and the second ramp surface extends from the transition zone to the detent.

28. The subsea system according to claim 27, wherein a thickness of the first ramp surface increases from the stop end towards the transition zone and a thickness of the second ramp surface decreases from the transition zone towards the detent.

29. The subsea system according to claim 28, wherein the second ramp surface is steeper than the first ramp surface.

30. The subsea system according to claim 20, wherein the axial groove is configured to guide a component latching portion of the subsea equipment in the axial direction (AD).

31. The subsea system according to claim 20, wherein the subsea receptacle comprises a pin guide for guiding an alignment pin of the subsea equipment.

32. A method of mounting a subsea equipment to a subsea receptacle, wherein the subsea equipment comprises:

a component body configured to be received inside the subsea receptacle, the component body extending along a component axis (CA) in an axial direction (AD) between a component connecting end (CCE) and a component locking end (CLE) and in a circumferential direction (CDC) about the component axis (CA), the circumferential direction (CDC) being orthogonal to the axial direction (AD); and a latching arrangement connected to the component locking end (CLE) and being configured to rotate in the circumferential direction (CDC), the latching arrangement comprising a rotatable portion rotatably connected to the component body, a component latching portion extending from the rotatable portion in the axial direction (AD) towards the component connecting end (CCE) and comprising a component latching surface extending in the circumferential direction (CDC) and facing towards said component locking end (CLE), a component locking portion, and a spring biasing the component locking portion in a radial direction orthogonal to the circumferential direction (CDC);

wherein the subsea receptacle comprises:

a receptacle body configured to receive the subsea equipment therein, the receptacle body extending along a receptacle axis (RA) in the axial direction (AD) between a receptacle connecting end (RCE) and a receptacle locking end (RLE) and in a circumferential direction (RDC) about the receptacle axis (RA), the receptacle body comprising:

an axial groove extending in the axial direction (AD) from the subsea receptacle connecting end (RCE) and terminating in a stop end; and a receptacle latching portion extending in the circumferential direction (RDC) from the stop end, the receptacle latching portion comprising a receptacle latching surface facing towards the receptacle connecting end (RCE), a detent configured to interact with the component locking portion of the latching arrangement of the subsea equipment to thereby counteract relative rotation between the latching arrangement and the subsea receptacle in the circumferential direction, and a ramp extending in the circumferential direction (RDC) between the stop end and the detent to guide the component locking portion of the latching arrangement towards the detent;

wherein the component latching surface is configured to interact with the receptacle latching surface to thereby counteract relative axial movement between the subsea receptacle and the subsea equipment;

wherein the method comprises:

a first step of moving the subsea equipment in the axial direction (AD) into the subsea receptacle; and a second step of rotating the latching arrangement of the subsea equipment in the circumferential direction (CDC) so as to latch the subsea equipment to the subsea receptacle both in the axial direction (AD) and in the circumferential direction (CDC).

* * * * *